US006728992B1

(12) United States Patent
Rogers

(10) Patent No.: US 6,728,992 B1
(45) Date of Patent: May 4, 2004

(54) RETRACTABLE DOOR SYSTEM

(76) Inventor: John Rogers, 727 Prospect Ave., Henderson, NV (US) 89015

( * ) Notice: Subject to any disclaimer, the term of this patent is extended or adjusted under 35 U.S.C. 154(b) by 12 days.

(21) Appl. No.: 10/044,753

(22) Filed: Jan. 14, 2002

(51) Int. Cl.[7] ..... E05F 1/08

(52) U.S. Cl. ..... 16/76; 16/78; 16/86 R; 16/86 A; 16/86 B; 16/77

(58) Field of Search ..... 16/76, 75, 71, 16/78, DIG. 10, 77, 86 R, 86 A, 86 B

(56) References Cited

U.S. PATENT DOCUMENTS

| | | | | | |
|---|---|---|---|---|---|
| 450,486 | A | * | 4/1891 | Harvey et al. | 16/78 |
| 684,742 | A | * | 10/1901 | Bromley | 16/78 |
| 1,014,266 | A | * | 1/1912 | Stutler | 16/78 |
| 1,186,720 | A | * | 6/1916 | Westhoff | 16/78 |
| 1,880,870 | A | * | 10/1932 | Demo | 16/78 |
| 1,881,114 | A | * | 10/1932 | Beeler | 16/78 |
| 3,145,946 | A | * | 8/1964 | Engle | 242/376 |
| 3,695,256 | A | * | 10/1972 | Brower | 602/32 |
| 4,665,584 | A | * | 5/1987 | Williams | 16/81 |
| 5,630,249 | A | * | 5/1997 | Rebai, Jr. | 16/78 |

FOREIGN PATENT DOCUMENTS

| | | | | |
|---|---|---|---|---|
| DE | 3514244 | A1 | * 10/1986 | E05C/17/54 |

* cited by examiner

*Primary Examiner*—Gary Estremsky
*Assistant Examiner*—Mark Williams

(57) ABSTRACT

A retractable door system for returning to a nearly closed position a door that has been opened having: a catch knob secured to a doorframe; a housing secured to a door; a retractable cord anchored within the housing at one end and having means for attaching to the catch knob at an opposite end; and a cord retracting means located within the housing for retracting the cord within the housing. The retractable door system may optionally further have a pad on the portion of the housing contacting a doorframe when the door is placed in a nearly closed position or a pad on the portion of the housing contacting a door or means for adjusting the tension of the retractable cord.

12 Claims, 3 Drawing Sheets

RETRACTABLE DOOR SYSTEM

BACKGROUND OF THE INVENTION

1. Field of the Invention

The present invention relates to a retractable door system for use in connection with returning to a nearly closed position a door that has been opened. The retractable door system of the present invention has particular utility in connection with permitting small animals to pass through a doorway.

2. Description of the Prior Art

The use of retractable door and tethering systems are known in the prior art. For example, U.S. Pat. No. 4,796,566 to Daniels discloses portable tethering system centered around a retractable leash cartridge. The disclosure of Daniels however, fails to disclose a tethering system for attachment to a door for indoor use.

U.S. Pat. No. 5,937,478 to Regnier discloses a ratcheted based system for closing sliding glass doors. Although the device of the Regnier patent discloses a system for closing a door, it cannot provide means for leaving that door partially open to permit pet traffic there through.

U.S. Pat. No. 4,675,938 to Bundschuh discloses an automatic retraction device for panels such as windows or doors. Although the device of the Bundschuh patent discloses a system for closing a door or window, it cannot provide means for leaving that door partially open to permit pet traffic there through.

U.S. Pat. No. 3,332,638 to Jessup et al. discloses a retractor device for doors with a brake. Although the device of the Jessup patent discloses a system for gently closing a door, it cannot provide means for leaving that door partially open to permit pet traffic there through.

U.S. Pat. No. 3,480,227 to Matthews discloses retractor device for doors with a compensating brake. Although the device of the Matthews patent discloses a system for closing a door, it cannot provide means for leaving that door partially open to permit pet traffic there through.

Lastly, U.S. Pat. No. Des. 296,758 to Ogawa et at disclose a sliding door closure. Although the device of the Ogawa patent discloses a system for closing a door, it cannot provide means for leaving that door partially open to permit pet traffic there through.

While the above-described devices fulfill their respective, particular objectives and requirements, the aforementioned patents do not describe a retractable door system that is placed over a conventional door and attaches to a doorframe allowing for the door to remain nearly closed but also allowing for pet traffic. The prior art of Daniels makes no provision for a etractable system that attaches to a door to control pet traffic. The prior art of Regnier, Bundschuh, Jessup et at, Matthews, and Ogawa et at each make no provision for leaving a door partially open to permit pet traffic through the door.

Therefore, a need exists for a new and improved retractable door system, which can be used to pet traffic while retaining the privacy of a closed door. In this regard, the present invention substantially fulfills this need. In this respect, the retractable door system according to the present invention substantially departs from the conventional concepts and designs of the prior art, and in doing so provides an apparatus primarily developed for the purpose of allowing pet traffic but also retaining the privacy of a nearly closed door for the pet owner.

SUMMARY OF THE INVENTION

In view of the foregoing disadvantages inherent in the known types of retractable door system present in the prior art, the present invention provides an improved, and overcomes the above-mentioned disadvantages and drawbacks of the prior art. As such, the general purpose of the present invention, which will be described subsequently in greater detail, is to provide a new and improved retractable door system which has all the advantages of the prior art mentioned heretofore and many novel features that result in a nearly closing an open door which is not anticipated, rendered obvious, suggested, or even implied by the prior art, either alone or in any combination thereof.

To attain this, the retractable door system present invention essentially comprises: a catch knob; a housing; a retractable cord anchored within the housing at one end and having means for attaching to the catch knob at an opposite end; and a cord retracting means located within the housing for retracting the cord within the housing thereby pulling nearly closed an open door.

The housing unit preferably comprises a circular unit for housing the cord retracting means and two rectangular extensions that hold the housing securely to a door and prevent the door from closing completely. The cord retracting means is preferably a spring-loaded roller. The retractable cord is preferably a waxed nylon cord. The catch knob is preferably a nail, hook or plastic molded projection. The catch knob is preferably secured to a doorframe by an adhesive, glue, nail or screw. The means for attaching the cord to the catch knob is preferably a plastic loop that fits securely over the catch knob.

In a second embodiment, the retractable door system may optionally further comprise a pad on the portion of the housing contacting a doorframe when the door is placed in a nearly closed position or a pad on the portion of the housing contacting a door.

In a third embodiment, the retractable door system may optionally further comprise means for adjusting the tension of the retractable cord. Preferably, the means for adjusting the tension of the retractable cord is a wing nut, where the housing unit comprises means for securing the wing nut, such as a threaded portion.

There has thus been outlined, rather broadly, the more important features of the invention in order that the detailed description thereof that follows may be better understood and in order that the present contribution to the art may be better appreciated.

The invention may also include variations of the retractable door system such as different shapes, sizes and colors of the housing, cord and knob, different lengths and types of cords, knobs and housings of different materials. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved retractable door system that has all of the advantages of the prior art retractable door systems and none of the disadvantages.

It is another object of the present invention to provide a new and improved retractable door system, which may be easily and efficiently manufactured and marketed.

It is further object of the present invention to provide a new and improved retractable door system, which is of a durable and reliable construction.

An even further object of the present invention is to provide a new and improved retractable door system, which is susceptible of a low cost of manufacture with regard to both materials and labor, and which accordingly is then susceptible of low prices of sale to the consuming public, thereby making such retractable door system economically available to the buying public.

Still another object of the present invention is to provide a retractable door system, which provides in the apparatuses and methods of the prior art some of the advantages thereof, while simultaneously overcoming some of the disadvantages normally associated therewith.

Even still another object of the present invention is to provide a retractable door system that permits opening a door a few inches to let small animals pass through a doorway while returning the door to a very nearly closed position.

Another object of the present invention is to provide a retractable door system that permits pet traffic but also retains the privacy of a nearly closed door.

Yet another object of the present invention is to provide a retractable door system the permits pet traffic without disturbing the pet owner.

Another object of the present invention is to provide a retractable door system that is adjustable and easily removable when not needed.

Still another object of the present invention is to provide a retractable door system that will fit on any conventional door and doorframe.

Yet another object of the present invention is to provide a retractable door system that allows hallway doors to become passable for an animal while hiding food, water bowls, litter boxes, or the like from view.

Still yet another object of the present invention is to provide a retractable door system that may work for heavy or lightweight doors.

Yet another object of the present invention is to provide a retractable door system in numerous color, size, and shape variations to match any household decor or doorframe size and shape.

Still even another object of the present invention is to provide a retractable door system for use by parents of small children that tend to leave doors open.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
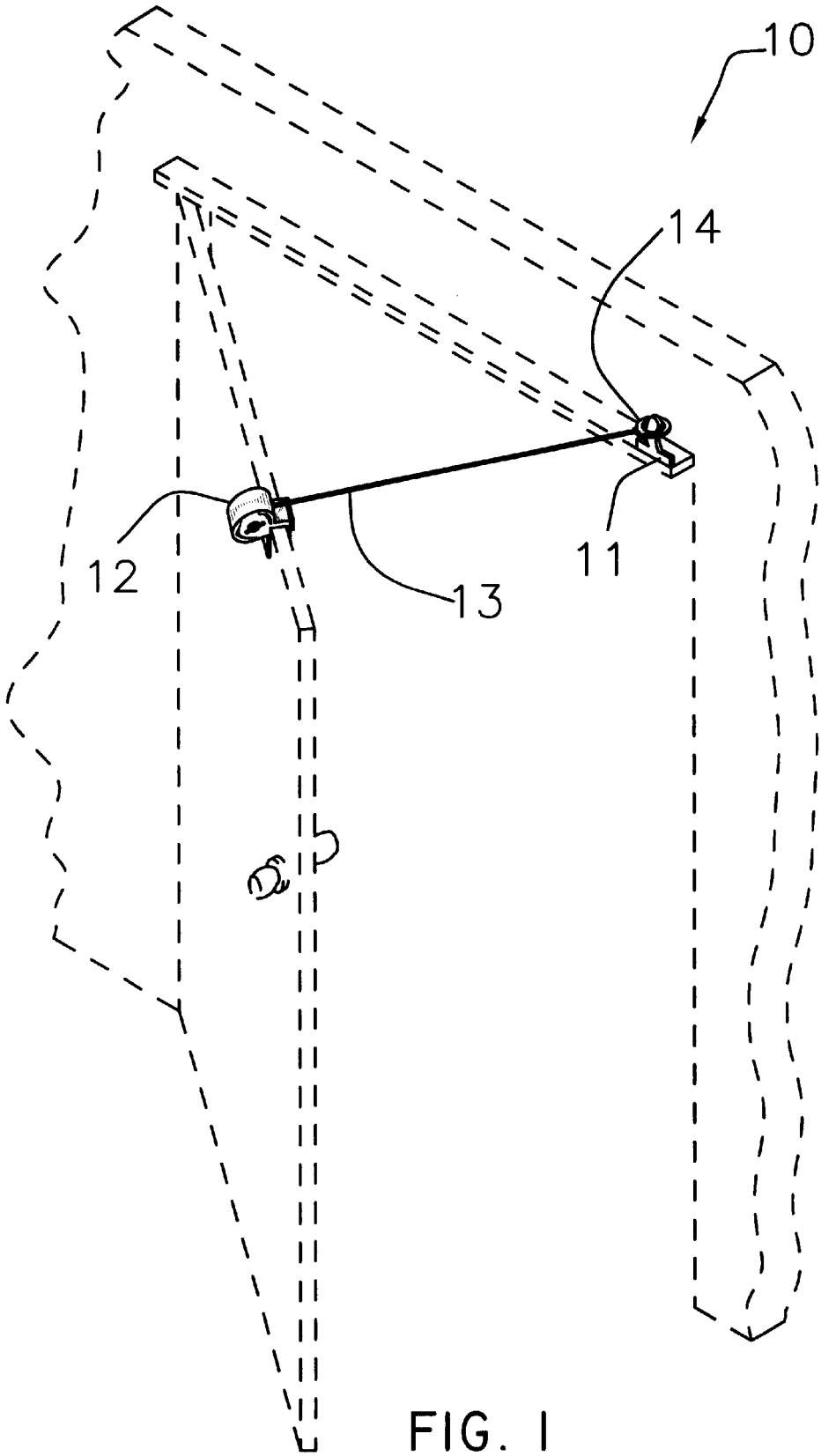
FIG. 1 is a perspective view of the preferred embodiment of the retractable door system constructed in accordance with the principles of the present invention.

Referring now to the drawings, particularly FIG. 1, a preferred embodiment of embodying the principles and concepts of the present invention and generally designated by the reference numeral 10 will be described.

In FIG. 1, the retractable door system 10 of the present invention is shown placed over a door represented by hatched lines and attached to a doorframe, also represented by hatched lines, via a catch knob 11. The retractable door system 10 comprises a housing 12 to be placed over a door, a strong, flexible and retractable cord 13 anchored within the housing at one end and having means for attaching 14 to the catch knob 11 at the opposite end of the cord 13.

Figure 2:
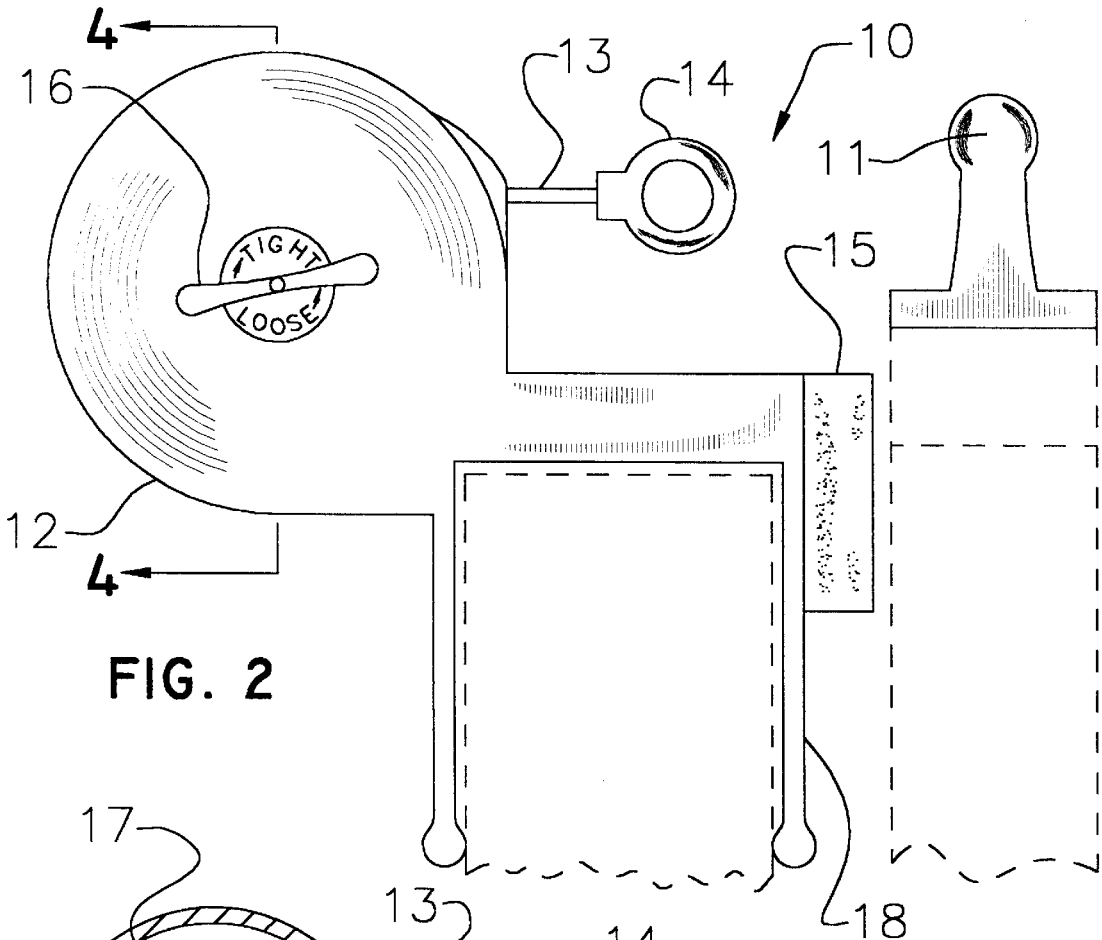
FIG. 2 is a perspective view of the retractable door system of the present invention.

As shown in FIG. 2, the retractable door system 10 of the present invention comprises housing 12 to be placed over a door, represented by dotted lines in FIG. 2. The housing 12 may comprise a circular portion and rectangular extensions 18 that hold the housing securely to a door and prevent the door from closing completely. The retractable door system further comprises a strong, flexible and retractable cord 13 anchored within the housing at one end and having means for attaching 14 to the catch knob 11 at the opposite end of the cord 13. The housing 12 may optionally comprise a pad 15 to rest against the doorframe, represented by hatched lines. The retractable door system of the present invention may optionally further comprise means 16 for adjusting the tension of the cord 13.

Figure 3:
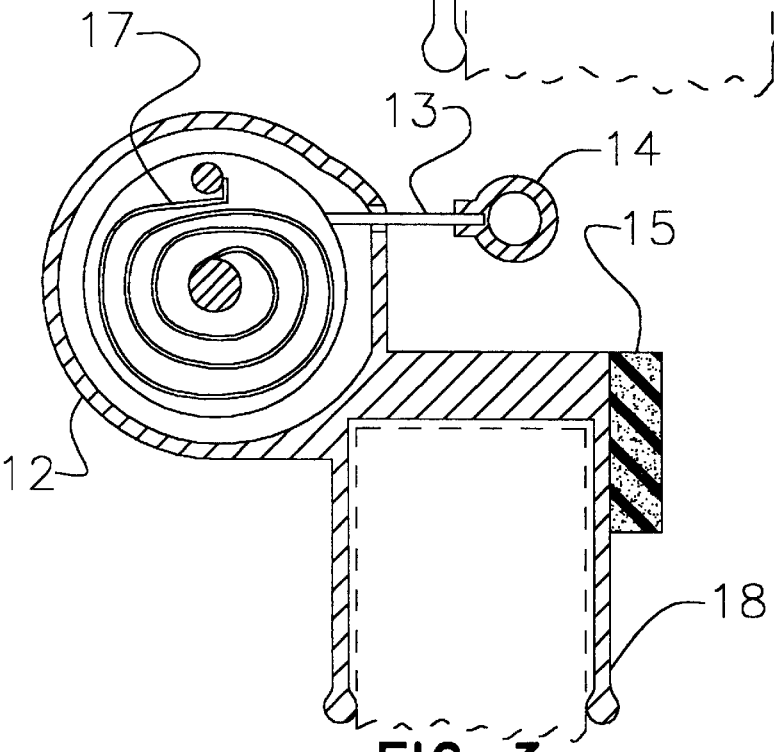
FIG. 3 is a cross sectional view of the retractable door system of the present invention.

As shown in FIG. 3, the retractable door system comprises a strong, flexible and retractable cord 13 anchored within the housing 12 at one end and having means for attaching 14 to a catch knob. The retractable door system may optionally-comprise a pad 15 to prevent damage to the doorframe when the retractable door system pulls closed the door. The housing 12 may comprise a circular portion that houses a spring-loaded roller 17 for retracting the cord within the housing while the retractable door system pulls a door closed. The housing may also comprise rectangular extensions 18 that hold the housing securely to a door and prevent the door from closing completely.

Figure 4:
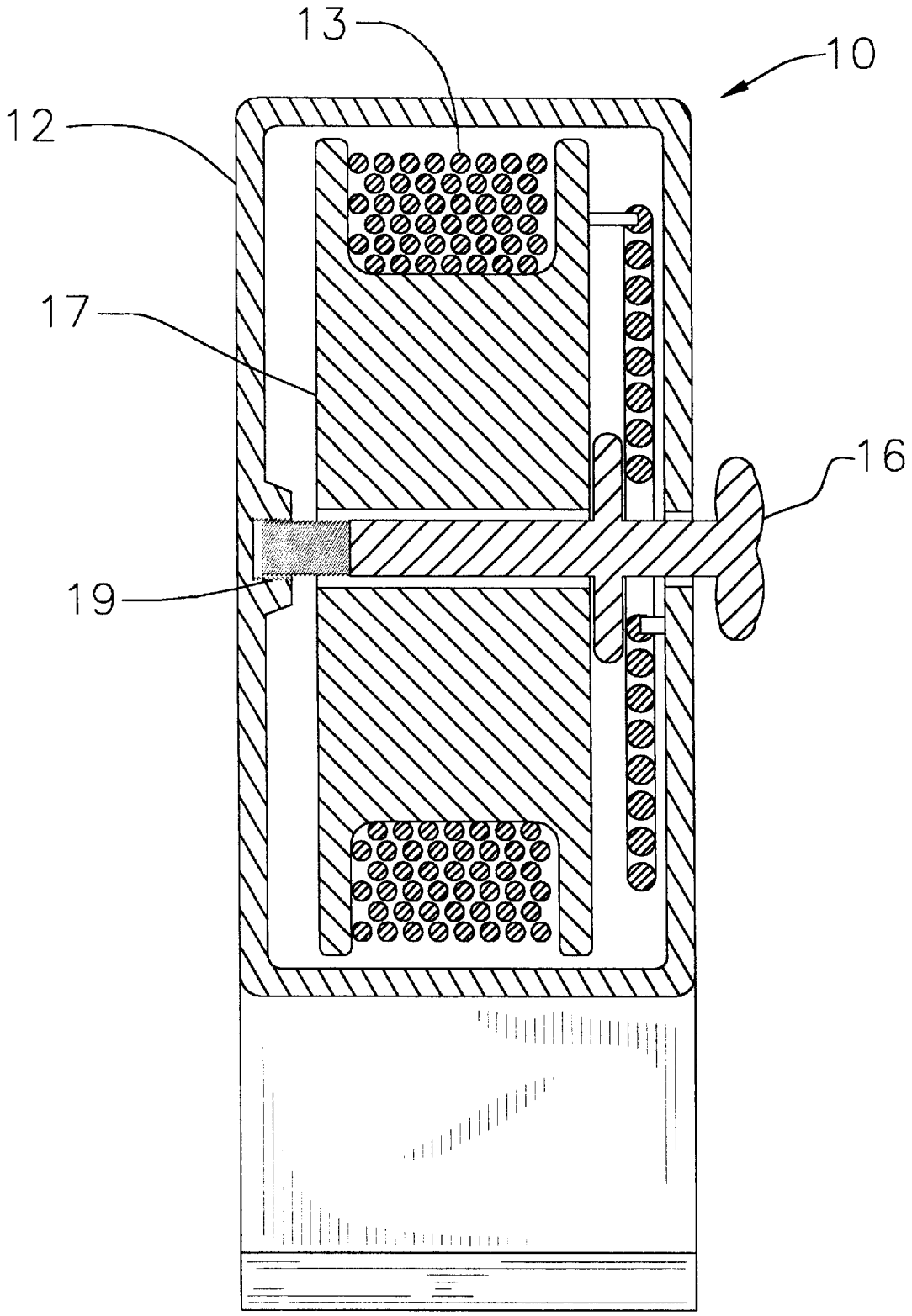
FIG. 4 is a cut away cross sectional view of the retractable door system of the present invention along the 4—4 axis of FIG. 2.

In FIG. 4, the interior of the housing 12 of the retractable door system 10 is shown. The housing may have a spring-loaded roller 17 for retracting the cord 13 within the housing while the retractable door system pulls a door closed. The cord 13 is anchored on the spring-loaded roller 17. In an optional embodiment, the retractable door system of the present invention may comprise means 16 for adjusting the tension of the cord 13. In FIG. 4, the means 16 for adjusting the tension is a wing nut and the housing 12 further comprises threaded portion 19 for securing the wing nut.

In FIGS. 2 and 3, an additional embodiment of the present invention is depicted. The housing 12 may optionally comprise a pad 15 to rest against the doorframe, represented by hatched lines. The pad 15 may be made of any material, such as sponge or foam, to prevent damage to the doorframe when the door is automatically closed and soften the sound of the closing door. Optionally a pad or the same or different material than the doorframe pad may be placed on any portion of the housing 12 that touches the door, represented by hatched lines, to additionally prevent damage to the door itself.

FIGS. 2 and 4 also describe yet another embodiment of the present invention. The retractable door system of the present invention may optionally further comprise means 16 for adjusting the tension of the cord 13. Preferably the means for adjusting tension 16 wing nut and the housing 12 further comprises a threaded portion 19 for securing the wing nut.

As shown in FIGS. 3 and 4, the housing 12 of the retractable door system comprises a spring-loaded roller 17 that serves as a mount for cord 13. The spring loaded roller retracts the cord 13 within the housing 12 thereby pulling closed the door to which the retractable door system is attached.

The housing 12 of the retractable door system of the present invention may be of any dimensions appropriate to a particular door system. The housing may be made any color. The housing may be made of any appropriate material. The housing unit houses means for retracting a retractable cord thereby pulling a door to a nearly closed position. Numerous means of attaching the housing unit to a door are envisioned. The housing unit may be attached to a door with a clamp or screws or the housing unit itself may comprise means for securing the unit to a door. The housing preferably includes a circular unit measuring approximately 4 to 5 inches in diameter and 2 to 3 inches wide, the housing also comprising rectangular extensions 18 that extend about 3 to 4 inches in order to hold the housing securely to a door and prevent the door from closing completely. Preferably the housing is made of a molded plastic casing. The outside of the housing may accommodate any writing or labels.

The catch knob 11 of the retractable door system of the present invention may be of any dimensions and shape appropriate to secure the end of the retractable nylon cord 13. The catch knob may comprise a nail or hook or molded plastic projection. The catch knob may be secured to a doorframe by any appropriate means, such as an adhesive, glue, nail, or screw or the like.

The cord 13 of the retractable door system of the present invention may be of any appropriate length, be any color and made of any sturdy material that will withstand extension and retraction from the spring loaded roller of the housing. The cord of the present invention is preferably a waxed nylon cord.

The retractable cord preferably comprises means for attaching to the catch knob at one end of the cord. Any appropriate means of attachment are envisioned in the present invention. Preferably the means for attachment comprises a plastic ring that fits securely over the catch knob and is securely fastened to the cord 13.

The housing of the retractable door system of the present invention also comprises means 17 for retracting the cord 13 when it is extended. The present invention comprises any means of repeatedly retracting the cord to pull closed a door that has been opened. Preferably the retracting means comprises a spring-loaded roller within the housing. Preferably the spring-loaded roller comprises a spring steel coil.

The retractable door system of the present invention may also comprise means for adjusting the tension 16 of the cord 13. The present invention comprises any means of adjusting the cord tension. Preferably the means for adjusting the tension of the cord comprises a wing nut. When a wing nut is used to adjust the tension of the device, the housing further comprises means for securing the wing nut to the housing such as a threaded portion 19 for accommodating the wing nut.

While a preferred embodiment of the retractable door system has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as metal or a variety of wood may be used instead of the plastic described. It should be appreciated that the retractable door system may come in any size or dimension suitable to a particular door construction and that the length, strength and construction of the cord may be varied depending upon the intended use. Although the retractable door system has been described with reference to pet traffic, it should appreciated that the retractable door system herein described is also suitable for any situation in which is it desired to keep a door mostly closed but permit traffic there through.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A door mounted device for nearly closing an opened door, comprising:

a catch knob;

a housing;

a pad on any portion of said housing contacting a doorframe when a door is placed in a nearly closed position;

a retractable cord anchored within the housing at one end and having means for attaching to said catch knob at an opposite end;

a cord retracting means located within the housing for retracting said cord within the housing thereby pulling nearly closed an open door; and means for adjusting the tension of said retractable cord comprising a wing nut having opposing ends with one end inserted through said cord retracting means and said housing further comprising means for securing said end of said wing nut.

2. The door mounted device of claim 1, wherein the housing unit comprises a circular unit for housing said cord retracting means and two rectangular extensions that hold the housing securely to a door and prevent the door from closing completely.

3. The door mounted device of claim 1, wherein the cord retracting means comprises a spring-loaded roller.

4. The door mounted device of claim 1, wherein the retractable cord is a waxed nylon cord.

5. The door mounted device of claim 1, wherein the catch knob is a nail, hook or plastic molded projection.

6. The door mounted device of claim 1, wherein the catch knob is secured to a doorframe by an adhesive, glue, nail or screw.

7. The door mounted device of claim 1, wherein the means for attaching said cord to said catch knob is a plastic loop that fits securely over the catch knob.

8. A door mounted device for nearly closing an opened door, comprising:

a catch knob;

a housing;

a retractable cord anchored within the housing at one end and having means for attaching to said catch knob at an opposite end;

a cord retracting means comprising a spring-loaded roller located within the housing for retracting said cord within the housing thereby pulling nearly closed an open door; and means for adjusting the tension of said retractable cord comprising a wing nut having opposing ends with one end inserted through said spring-loaded roller and said housing further comprising means for securing said end of said wing nut.

9. The door mounted device of claim 8, wherein the housing unit comprises a circular unit for housing said cord retracting means and two rectangular extensions that hold the housing securely to a door and prevent the door from closing completely.

10. The door mounted device of claim 9, wherein the housing unit further comprises a pad on any portion of the housing contacting a doorframe when a door is placed in a nearly closed position.

11. The door mounted device of claim 10, wherein the means for attaching said cord to said catch knob is a plastic loop that fits securely over the catch knob.

12. A door mounted device for nearly closing an opened door, comprising:

a catch knob;

a housing;

a pad on any portion of said housing contacting a doorframe when a door is placed in a nearly closed position;

a retractable cord anchored within the housing at one end and having a plastic loop that fits securely over said catch knob at an opposite end;

a cord retracting means comprising a spring-loaded roller located within the housing for retracting said cord within the housing thereby pulling nearly closed an open door; and means for adjusting the tension of said retractable cord comprising a wing nut having opposing ends with one end inserted through said spring-loaded roller and said housing further comprising means for securing said end of said wing nut.

* * * * *